US008215785B2

(12) United States Patent
Ban et al.

(10) Patent No.: US 8,215,785 B2
(45) Date of Patent: Jul. 10, 2012

(54) ELECTRONIC DEVICE AND FILM FOR THE SAME

(75) Inventors: Hee-Jeong Ban, Ansan-si (KR); Sun-Woong Shin, Ansan-si (KR)

(73) Assignee: Seoul Semiconductor Co., Ltd., Seoul (KR)

( * ) Notice: Subject to any disclaimer, the term of this patent is extended or adjusted under 35 U.S.C. 154(b) by 341 days.

(21) Appl. No.: 12/491,090

(22) Filed: Jun. 24, 2009

(65) Prior Publication Data

US 2009/0323354 A1 Dec. 31, 2009

(30) Foreign Application Priority Data

Jun. 30, 2008 (KR) ..... 10-2008-0062738

(51) Int. Cl.
*G09F 13/04* (2006.01)

(52) U.S. Cl. . 362/97.3; 362/97.2; 362/247; 362/249.02; 362/311.01; 362/330

(58) Field of Classification Search ..... 362/97.2, 362/97.3, 247, 249.2, 311.01, 330, 249.02
See application file for complete search history.

(56) References Cited

U.S. PATENT DOCUMENTS

| | | | | |
|---|---|---|---|---|
| 6,637,916 | B2 * | 10/2003 | Mullner | 362/486 |
| 7,276,854 | B1 * | 10/2007 | Deutsch et al. | 315/77 |
| 7,717,596 | B1 * | 5/2010 | Bell | 362/494 |
| 7,946,728 | B2 * | 5/2011 | Tang et al. | 362/253 |
| 2005/0237747 | A1 * | 10/2005 | Shimizu et al. | 362/294 |
| 2008/0130296 | A1 * | 6/2008 | Sugimachi et al. | 362/351 |
| 2008/0137349 | A1 * | 6/2008 | Jo et al. | 362/326 |
| 2008/0310019 | A1 * | 12/2008 | Um et al. | 359/485 |
| 2009/0322709 | A1 * | 12/2009 | Lee et al. | 345/176 |

* cited by examiner

*Primary Examiner* — Stephen F Husar
*Assistant Examiner* — James Cranson, Jr.
(74) *Attorney, Agent, or Firm* — H.C. Park & Associates, PLC

(57) ABSTRACT

An electronic device that includes a light-emitting board and a light characteristics enhancing member. The light-emitting board includes a driving substrate, a semiconductor device disposed on a first surface of the driving substrate, and a signal-receiving member receiving an external wireless control signal to control the semiconductor device. The light characteristics enhancing member includes a base film disposed over the light-emitting board, and a light characteristics enhancing layer formed on a lower surface of the base film, the lower surface facing the light-emitting board. A second refractive index of the light characteristics enhancing layer is greater than a first refractive index of the base film. Therefore, the receive sensitivity of the external wireless control signal is improved.

20 Claims, 2 Drawing Sheets

ELECTRONIC DEVICE AND FILM FOR THE SAME

CROSS REFERENCE TO RELATED APPLICATION

This application claims priority from and the benefit of Korean Patent Application No. 2008-62738, filed on Jun. 30, 2008, which is hereby incorporated by reference for all purposes as if fully set forth herein.

BACKGROUND OF THE INVENTION

1. Field of the Invention

Exemplary embodiments of the present invention relates to an electronic device and a film for the electronic device, and more particularly, to an electronic device operating by receiving a wireless control signal and a film for the electronic device.

2. Discussion of the Background

A light-emitting diode (LED) has qualities such as high efficiency, long lifespan, low power consumption, environmentally friendly, etc., as a light source. Therefore, the LED is widely used in various industrial fields.

In general, an electronic device may include a light-emitting board including an LED to generate light, a cover mold covering the light-emitting board, and a light characteristics enhancing member disposed over the light-emitting board to enhance characteristics of the light. The light characteristics enhancing member includes a base film disposed over the light-emitting board, and a light characteristics enhancing layer formed on a first surface of the base film, which is opposite to the light-emitting board, in order to enhance characteristics of light. A light-diffusing layer for diffusing light may be employed as the light characteristics enhancing layer.

The electronic device may receive a wireless control signal generated by an external remote controller, to be operated in response to the wireless control signal. In order for that, the light-emitting board may further include a signal-receiving member receiving the wireless control signal passing through the light characteristics enhancing member.

However, when the wireless control signal passes through the light characteristics enhancing member, the wireless control signal may be reflected by an interface between the base film and the light characteristics enhancing layer. As mentioned above, when the wireless control signal is reflected by the interface between the base film and the light characteristics enhancing layer, an amount of the wireless control signal passing through the light characteristics enhancing member decreases, resulting in lowered receive sensitivity of the signal-receiving member.

SUMMARY OF THE INVENTION

Exemplary embodiments of the present invention provide an electronic device capable of enhancing a receive sensitivity of a wireless control signal.

Additional features of the invention will be set forth in the description which follows, and in part will be apparent from the description, or may be learned by practice of the invention.

An exemplary embodiment of the present invention discloses a light-emitting board that includes a driving substrate, a semiconductor device disposed on a surface of the driving substrate, and a signal-receiving member disposed on a surface of the driving substrate; and a light characteristics enhancing member that includes a base film disposed over the light-emitting board, and a light characteristics enhancing layer disposed on a lower surface of the base film, wherein the lower surface of the base film faces the light-emitting board.

An exemplary embodiment of the present invention also discloses a base film having a first refractive index, a light characteristics enhancing layer formed on a lower surface of the base film, wherein the light characteristics enhancing layer has a second refractive index that is greater than the first refractive index.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
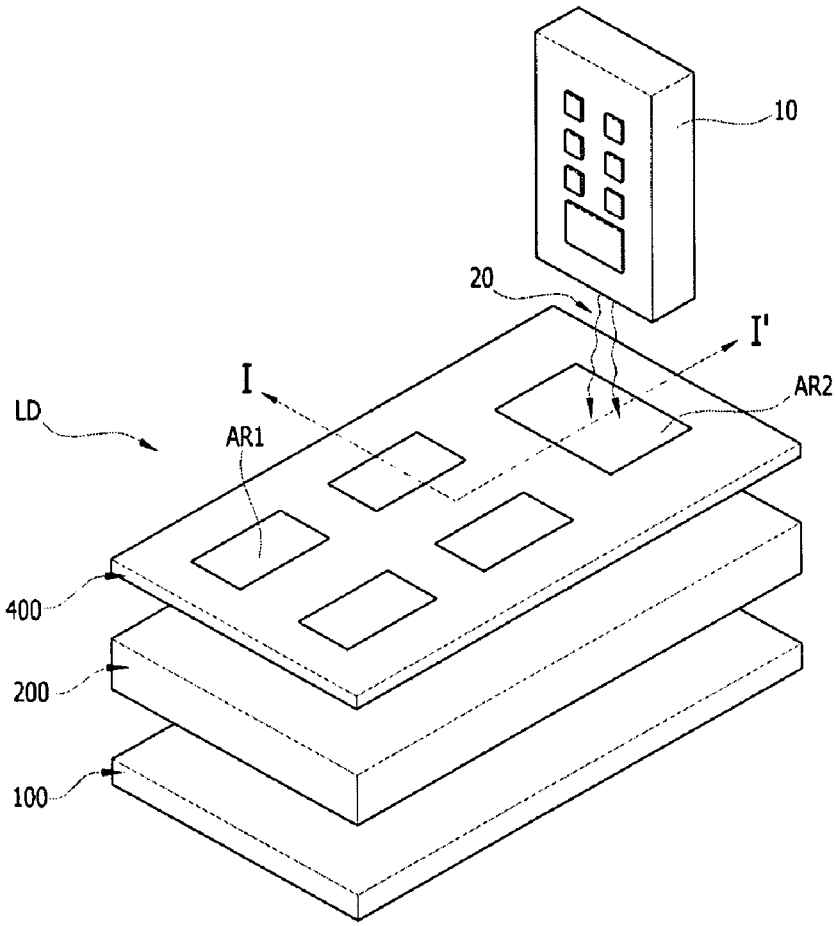
FIG. 1 is a perspective view illustrating an electronic device according to an exemplary embodiment of the present invention.

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure is thorough, and will fully convey the scope of the invention to those skilled in the art. In the drawings, the size and relative sizes of layers and regions may be exaggerated for clarity. Like reference numerals in the drawings denote like elements.

It will be understood that when an element or layer is referred to as being "on" or "connected to" another element or layer, it can be directly on or directly connected to the other element or layer, or intervening elements or layers may be present. In contrast, when an element is referred to as being "directly on" or "directly connected to" another element or layer, there are no intervening elements or layers present.

Figure 2:
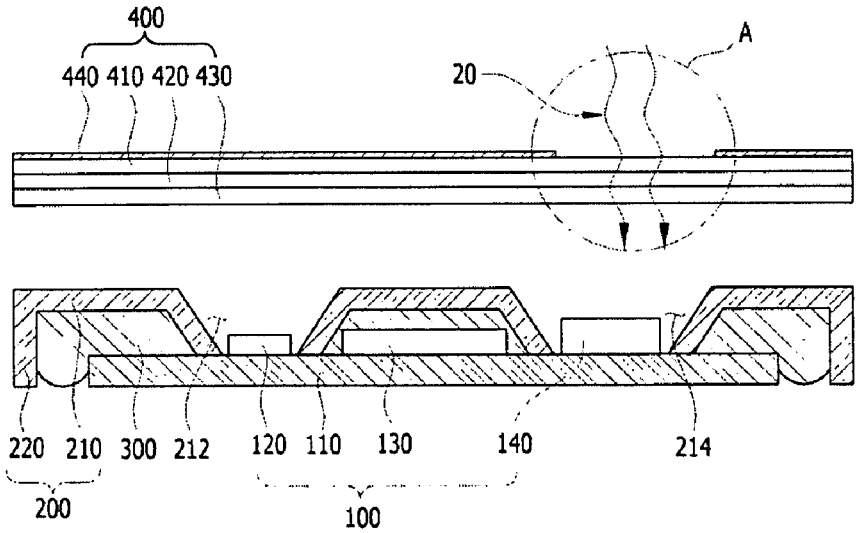
FIG. 2 is a cross-sectional view taken along line I-I' in FIG. 1.

FIG. 1 is a perspective view illustrating an electronic device according to an exemplary embodiment of the present invention, and FIG. 2 is a cross-sectional view taken along line I-I' in FIG. 1.

Referring to FIG. 1 and FIG. 2, an electronic device LD according to an exemplary embodiment of the present invention includes a light-emitting board 100 generating light, a cover mold 200 covering the light-emitting board 100, a molding member 300 molding a space between the light-emitting board 100 and the cover mold 200, and a light characteristics enhancing member 400 disposed over the cover mold 200.

The light-emitting board 100 may include a driving substrate 110, at least one semiconductor device 120 mounted on a first surface of the driving substrate 110, a driving member 130 driving the semiconductor device 120, and a signal-receiving member 140 receiving a signal for controlling the driving member 130.

The driving substrate 110 may be, for example, a printed circuit board (PCB) having a plurality of wirings. The semiconductor device 120, the driving member 130 and the signal-receiving member 140 are disposed on the driving substrate 110. The driving member 130 is electrically connected to the semiconductor device 120 to drive the semiconductor device 120. The signal-receiving member 140 is electrically connected to the driving member 130 to receive a wireless control signal 20 generated by an external remote controller 10 in order to drive the driving member 130.

The semiconductor device 120 may include at least one light-emitting diode (LED) operating as a point light source. For example, the semiconductor device 120 may includes at least one of a red LED, a green LED, and a blue LED, or a white LED. Alternatively, the semiconductor device 120 may include an organic light-emitting diode (OLED).

The cover mold 200 is disposed on the driving substrate 110 to cover the driving substrate 110, and may be combined with the driving substrate 110. In detail, the cover mold 200 may include a mold cover portion 210 and a mold sidewall portion 220.

The mold cover portion 210 is disposed over the driving substrate 110 to cover the driving substrate 110. The mold cover portion 210 may include a light-emitting recess 212 and a signal-receiving recess 214. The light-emitting recess 212 is disposed corresponding to the semiconductor device 120 to expose the semiconductor device 120. The signal-receiving recess 214 is disposed corresponding to the signal-receiving member 140 to expose the signal-receiving member 140. Therefore, a light generated by the semiconductor device 120 may be emitted through the light-emitting recess 212, and the signal-receiving member 140 may receive the wireless control signal 20 through the signal-receiving recess 214.

The mold sidewall portion 220 is formed along edges of the mold cover portion 210 facing the driving substrate 110. As a result, the mold cover portion 210 and the mold sidewall portion 220 define a receiving space capable of receiving the light-emitting board 100.

The cover mold 200 may allow the wireless control signal 20 to pass therethrough. In other words, the wireless control signal 20 may pass through the cover mold 200. When the cover mold 200 allows the wireless control signal 20 to pass therethrough, the signal-receiving member 140 may be formed under the cover mold 200 instead of the mold cover portion 210.

The molding member 300 is formed between the light-emitting board 100 and the cover mold 200 to cover the first surface of the driving substrate 110. Furthermore, the molding member 300 fills the space between the light-emitting board 100 and the cover mold 200 to combine the cover mold 200 and the light-emitting board 100 with each other.

The light characteristics enhancing member 400 is disposed on the cover mold 200 to be attached to the cover mold 200. The light characteristics enhancing member 400 may enhance characteristics of light generated by the semiconductor device 120 to pass through the light-emitting recess 212. A light-diffusing member for diffusing light may be employed as the light characteristics enhancing member 400. The light characteristics enhancing member 400 may have a light-emitting region AR1 corresponding to the light-emitting recess 212 and a signal-receiving region AR2 corresponding to the signal-receiving recess 214.

The light characteristics enhancing member 400 may include a base film 410, a light characteristics enhancing layer 420, an adhesive layer 430 and a display panel layer 440.

The base film 410 is disposed over the cover mold 200, and includes optically transparent synthetic resin. For example, the base film 410 may include polyethylene terephtalate (PET).

The light characteristics enhancing layer 420 is formed on a lower surface of the base film 410, the lower surface facing the cover mold 200. The light characteristics enhancing layer 420 enhances characteristics of light exiting the light-emitting recess 212. For example, a light-diffusing layer including a plurality of light characteristics enhancing particles (not shown) distributed therein for diffusing light may be employed as the light characteristics enhancing layer 420.

The adhesive layer 430 is formed on a lower surface of the light characteristics enhancing layer 420, the lower surface facing the cover mold 200. The adhesive layer 430 makes the base film 410 and the light characteristics enhancing layer 420 be attached to the cover mold 200.

The display panel layer 440 is formed on an upper surface of the base film 410, the upper surface being opposite to the cover mold 200. The display panel layer 440 may have various images, characters, etc., which are indicating status, menu, etc. The display panel layer 440 may have an opening portion corresponding to the signal-receiving region AR2 through which the wireless control signal 20 passes, so that the wireless control signal 20 may pass through the light characteristics enhancing member 400 without obstruction of the display panel layer 440.

Figure 3:
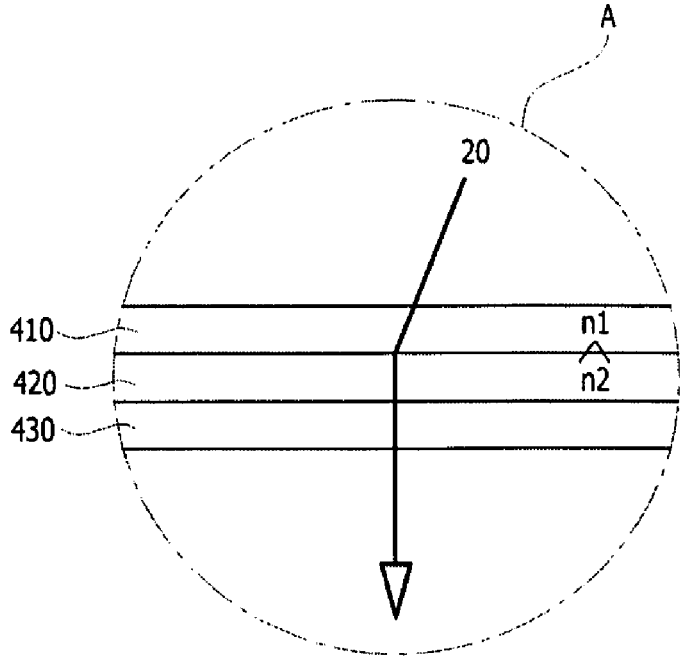
FIG. 3 and FIG. 4 are enlarged views illustrating portion A in FIG. 2.
Figure 4:
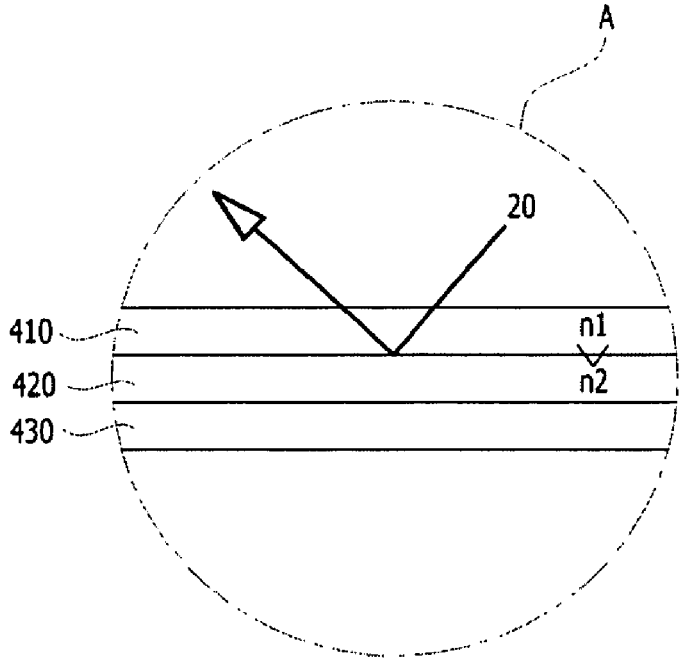

FIGS. 3 and 4 are enlarged views illustrating an A-portion in FIG. 2.

Referring to FIG. 3, the base film 410 has a first refractive index n1, and the light characteristics enhancing layer 420 has a second refractive index n2 that is greater than the first refractive index n1.

When the second refractive index n2 of the light characteristics enhancing layer 420 is greater than the first refractive index n1 of the base film 410, the wireless control signal 20 is not totally reflected by the interface between the base film 410 and the light characteristics enhancing layer 420 but downwardly refracted.

On the contrary, when the second refractive index n2 of the light characteristics enhancing layer 420 is smaller than the first refractive index n1 of the base film 410 as shown in FIG. 4, the wireless control signal 20 is totally reflected by the interface between the base film 410 and the light characteristics enhancing layer 420, so that the wireless signal may not pass through the light characteristics enhancing member 400.

As a result, when the light characteristics enhancing layer 420 having a greater refractive index than that of the base film 410 is formed on the lower surface of the base film 410, the wireless control signal 20 is prevented from being totally reflected by the interface between the base film 410 and the light characteristics enhancing layer 420 to enhance wireless control signal transmissivity of the light characteristics enhancing member 400. Furthermore, when the difference between the refractive index of the base film 410 and the refractive index of the light characteristics enhancing layer 420 increases, the wireless control signal transmissivity of the light characteristics enhancing member 400 is more improved.

As described above, according to the present invention, the light characteristics enhancing layer 420 having the second refractive index n2 that is greater than the first refractive index n1 of the base film 410 is formed on the lower surface of the base film 410, which faces the cover mold 200, so that the wireless control signal 20 is prevented from being totally reflected by the interface between the base film 410 and the light characteristics enhancing layer 420. Therefore, the receive sensitivity of the signal-receiving member 140 may be enhanced to receive the wireless control signal 20.

Additionally, by adjusting the difference between the refractive indexes of the base film 410 and the light characteristics enhancing layer 420, the receive sensitivity of the signal-receiving member 140 may be adjusted to receive the wireless control signal 20. That is, when the difference between the refractive index of the base film 410 and the light characteristics enhancing layer 420 is relatively greater, the receive sensitivity of the signal-receiving member 140 is enhanced, so that the electronic device (LD) may be controlled by the remote controller 10 at a relatively longer distance. On the contrary, when the difference between the refractive index of the base film 410 and the light characteristics enhancing layer 420 is relatively smaller, the receive sensitivity of the signal-receiving member 140 is lowered, so that the electronic device (LD) may be controlled by the remote controller 10 only at a relatively shorter distance.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. An electronic device, comprising:

a light-emitting board comprising a driving substrate, a semiconductor device disposed on the driving substrate, and a signal-receiving member disposed on the driving substrate; and a light characteristics enhancing member comprising a base film disposed over the light-emitting board, and a light characteristics enhancing layer disposed on a lower surface of the base film, the lower surface of the base film facing the light-emitting board.

2. The electronic device of claim 1, wherein a refractive index of the light characteristics enhancing layer is greater than a refractive index of the base film.

3. The electronic device of claim 1, further comprising a cover mold disposed between the light characteristics enhancing member and the light-emitting board.

4. The electronic device of claim 3, wherein the cover mold covers the light-emitting board.

5. The electronic device of claim 3, wherein the light characteristics enhancing member further comprises an adhesive layer disposed on a lower surface of the light characteristics enhancing layer.

6. The electronic device of claim 5, wherein the adhesive layer further comprises attaching the light characteristics enhancing member to the cover mold.

7. The electronic device of claim 3, wherein the cover mold comprises a light-emitting recess exposing the semiconductor device, and a signal-receiving recess exposing the signal-receiving member.

8. The electronic device of claim 7, wherein the cover mold further comprises a mold cover portion disposed over the driving substrate, the mold cover portion comprising the light-emitting recess and the signal-receiving recess.

9. The electronic device of claim 8, wherein the cover mold further comprises a mold sidewall portion formed along edges of the mold cover portion facing the driving substrate.

10. The electronic device of claim 1, where the light-emitting board further comprises a driving member disposed on the driving substrate and electrically connecting the signal-receiving member and the semiconductor device with each other.

11. The electronic device of claim 10, wherein the driving member drives the semiconductor device in response to an external wireless control signal applied to the signal-receiving member.

12. The electronic device of claim 1, wherein the semiconductor device comprises one of a light emitting diode (LED) and an organic light emitting diode (OLED).

13. A film, comprising:

a base film having a first refractive index;

a light characteristics enhancing layer formed on a lower surface of the base film, the light characteristics enhancing layer having a second refractive index that is greater than the first refractive index;

an adhesive layer formed on a lower surface of the light characteristics enhancing layer for being attached to an external device; and a display panel layer comprising an upper light exit surface and a lower surface formed on an upper surface of the base film.

14. The film of claim 13, wherein the light characteristics enhancing layer comprises a light-diffusing layer comprising one or more light characteristics enhancing particles.

15. The film of claim 14, wherein the display panel layer comprises an opening portion, wherein the opening portion is configured to pass a wireless control signal therethrough.

16. The film of claim 15, wherein the opening portion is formed at a signal-receiving region.

17. The Film of claim 15 wherein the display panel layer comprises an image or a character indicating a status or a menu.

18. The film of claim 13, wherein the base film comprises an optically transparent synthetic resin.

19. The film of claim 13, further comprising a light-emitting region corresponding to a light-emitting recess of the external device and a signal-receiving region corresponding to a signal-receiving recess of the external device.

20. A film, comprising:

a base film having a first refractive index;

a light characteristics enhancing layer formed on a lower surface of the base film, the light characteristics enhancing layer having a second refractive index that is greater than the first refractive index; and a display panel layer comprising an opening portion to pass a wireless control signal.

* * * * *